US010586404B1

(12) United States Patent
Nguyen

(10) Patent No.: US 10,586,404 B1
(45) Date of Patent: Mar. 10, 2020

(54) LOAD IMBALANCE FACTOR ESTIMATION

(71) Applicant: Lytx, Inc., San Diego, CA (US)

(72) Inventor: Vincent Nguyen, San Diego, CA (US)

(73) Assignee: Lytx, Inc., San Diego, CA (US)

( * ) Notice: Subject to any disclaimer, the term of this patent is extended or adjusted under 35 U.S.C. 154(b) by 87 days.

(21) Appl. No.: 15/372,282

(22) Filed: Dec. 7, 2016

(51) Int. Cl.
*G07C 5/00* (2006.01)
*G07C 5/08* (2006.01)

(52) U.S. Cl.
CPC ..... *G07C 5/008* (2013.01); *G07C 5/0808* (2013.01)

(58) Field of Classification Search
CPC ..... G07C 5/008; G07C 5/0808; B60W 30/04
See application file for complete search history.

(56) References Cited

U.S. PATENT DOCUMENTS 5,416,706 A * 5/1995 Hagenbuch ..... G01G 19/08 177/136
5,631,832 A * 5/1997 Hagenbuch ..... G01G 19/08 340/989
6,064,924 A * 5/2000 Fleischmann ..... G01S 7/411 701/16
8,610,708 B2 * 12/2013 Richards ..... G06T 7/536 345/419
2004/0002795 A1 * 1/2004 Tanimoto ..... B60T 8/172 701/1
2009/0097038 A1 * 4/2009 Higgins-Luthman ..... B60G 17/019 356/602
2014/0214299 A1 * 7/2014 Risse ..... B60T 7/12 701/70
2014/0240500 A1 * 8/2014 Davies ..... H04N 7/183 348/148
2016/0016591 A1 * 1/2016 Yokota ..... B60W 40/114 701/34.4

* cited by examiner

*Primary Examiner* — Thomas E Worden
(74) *Attorney, Agent, or Firm* — Van Pelt, Yi & James LLP

(57) ABSTRACT

A system for determining a load imbalance factor includes an input interface and processor. The interface is configure to receive sensor data from one or more sensors. The processor is configured to determine one or more vehicle tilts based at least in part on the sensor data; determine a load imbalance factor based at least in part on the one or more vehicle tilts; and provide the load imbalance factor.

15 Claims, 13 Drawing Sheets

LOAD IMBALANCE FACTOR ESTIMATION

BACKGROUND OF THE INVENTION

Load imbalance of a vehicle can lead to a decrease in maneuverability and increase in vehicle wear. The decrease in maneuverability may lead to an increase in accidents because the vehicle handling is impaired. The increase in vehicle wear may lead to an increase in maintenance costs. However, when driving, it is not always immediately clear that the vehicle is loaded in an in balanced way.

BRIEF DESCRIPTION OF THE DRAWINGS

Various embodiments of the invention are disclosed in the following detailed description and the accompanying drawings.

DETAILED DESCRIPTION

Figure 1:
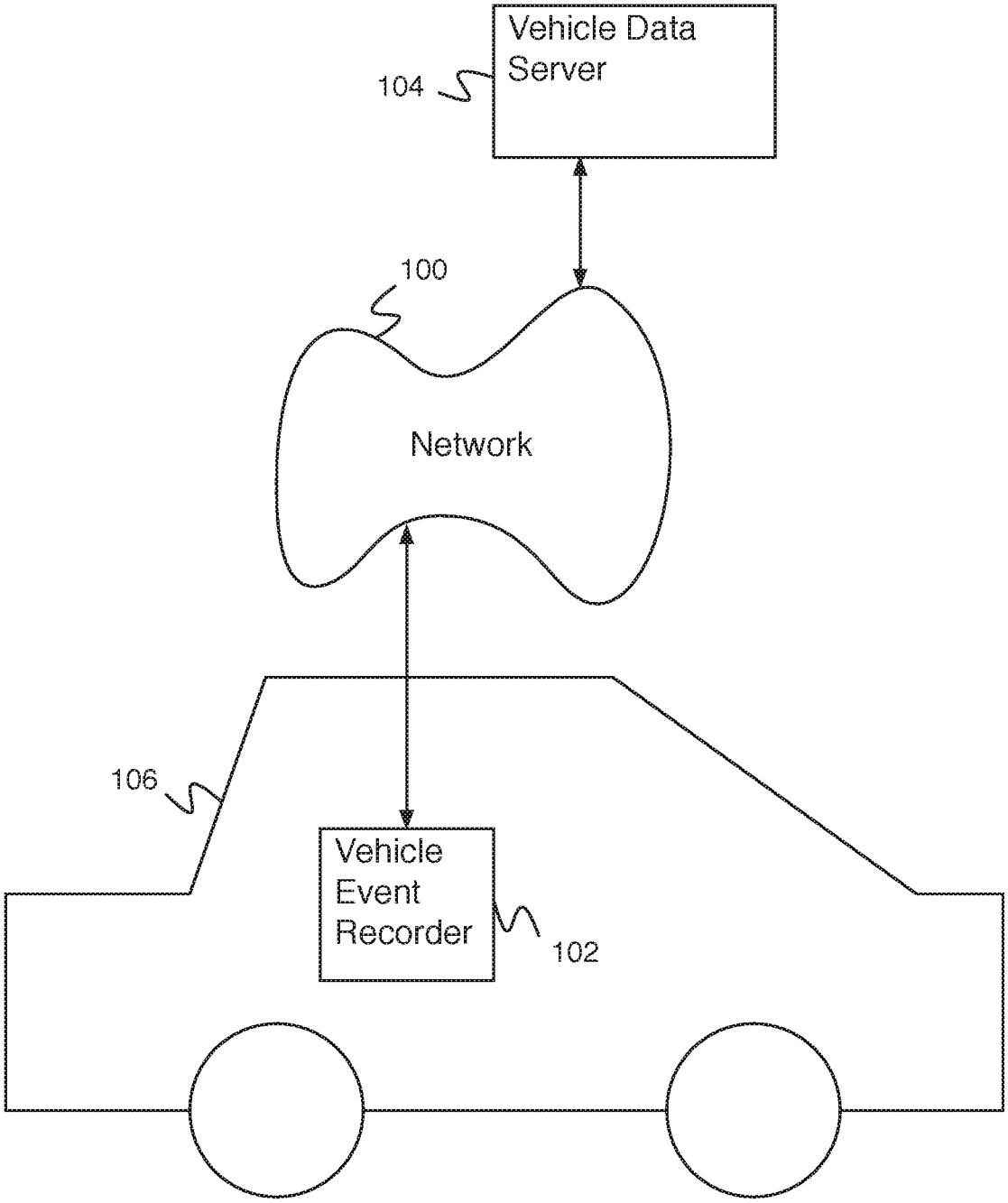
FIG. 1 is a block diagram illustrating an embodiment of a system including a vehicle event recorder.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for determining a load imbalance factor is disclosed. The system comprises an input interface and a processor. The input interface is configured to receive sensor data from one or more sensors. The processor is configured to determine one or more vehicle tilts based at least in part on the sensor data, determine a load imbalance factor based at least in part on the one or more vehicle tilts, and provide the load imbalance factor. In some embodiments, the system for determining a load imbalance factor additionally comprises a memory coupled to the processor and configured to provide the processor with instructions.

In some embodiments, a system for determining a load imbalance factor comprises a system for determining a load imbalance factor based on vehicle sensor data. The system determines tilts (e.g., vehicle forward tilt, vehicle lateral tilt, etc.) using vehicle sensor data. The system uses the tilts to determine a load imbalance factor indicating the degree to which the vehicle has a load that is not balanced or loaded with a recommended weight distribution. The load imbalance factor can be provided to a user, a server, or stored. In some embodiments, the load imbalance factor is used to determine a change in thresholds for event detection (e.g., a change in sensitivity as to what is identified as an event). In some embodiments, the load imbalance factor is used to determine an anticipated maintenance issue (e.g., the effect of increased wear and tear on brakes, tires, shocks, etc. that occurs differently based on the loading, particularly imbalanced loading that increases wear and tear).

In some embodiments, the system for determining road conditions system is a part of a vehicle event recorder. The vehicle event recorder receives sensor data from internal and external (e.g., vehicle and network accessible) sensor systems. In various embodiments, internal vehicle event recorder or vehicle sensor data comprises accelerometer data, shock data, gyro data, external facing camera data, or any other appropriate data. The system measures or receives sensor data during a maneuver (e.g., an accelerating maneuver, a braking maneuver, a cornering maneuver, etc.). The system then determines vehicle maneuver data (e.g., maneuver type, maneuver path, maneuver rate, etc.) based at least in part on the sensor data. The system determines a set of vehicle tilts (e.g., measured tilts of the vehicle) and a set of correctly loaded tilts (e.g., determinations of the tilts that would be measured during the vehicle maneuver in the event the vehicle is correctly loaded). Using these vehicle tilts and correctly loaded tilts, a load imbalance factor is determined.

FIG. 1 is a block diagram illustrating an embodiment of a system including a vehicle event recorder. In the example shown, vehicle event recorder 102 is mounted in a vehicle 106 (e.g., a car, truck, commercial vehicle, etc.) and communicates with vehicle data server 104 via network 100. Vehicle event recorder 102 includes or is in communication with a set of sensors—for example, video recorders, audio recorders, accelerometers, gyroscopes, vehicle state sensors, proximity sensors, a global positioning system (GPS), outdoor temperature sensors, moisture sensors, laser line tracker sensors, or any other appropriate sensors. In various embodiments, vehicle state sensors comprise a speedometer, an accelerator pedal sensor, a brake pedal sensor, an engine revolutions per minute (RPM) sensor, an engine temperature sensor, a headlight sensor, an airbag deployment sensor, driver and passenger seat weight sensors, an anti-locking brake sensor, traction control system sensors, drive wheel speed sensors, shocks sensors, an engine exhaust sensor, a gear position sensor, a cabin equipment operation sensor, or any other appropriate vehicle state sensors. Vehicle event recorder 102 comprises a system for processing sensor data and detecting events. In various embodiments, vehicle event recorder 102 is mounted on vehicle 106 in one of the following locations: the chassis, the front grill, the dashboard, the rear-view mirror, or any other appropriate location. In some embodiments, vehicle event recorder 102 comprises multiple units mounted in different locations in vehicle 106. In some embodiments, vehicle event recorder 102 comprises a communications system for communicating with network 100. In various embodiments, network 100 comprises a wireless network, a wired network, a cellular network, a Code Division Multiple Access (CDMA) network, a Global System for Mobile Communication (GSM) network, a Long-Term Evolution (LTE) network, a Universal Mobile Telecommunications System (UMTS) network, a Worldwide Interoperability for Microwave Access (WiMAX) network, a Dedicated Short-Range Communications (DSRC) network, a local area network, a wide area network, the Internet, or any other appropriate network. In some embodiments, network 100 comprises multiple networks, changing over time and location. In some embodiments, different networks comprising network 100 comprise different bandwidth cost (e.g., a wired network has a very low cost, a wireless Ethernet connection has a moderate cost, a cellular data network has a high cost). In some embodiments, network 100 has a different cost at different times (e.g., a higher cost during the day and a lower cost at night). Vehicle data server 104 comprises a vehicle data server for collecting events detected by vehicle event recorder 102. In some embodiments, vehicle data server 104 comprises a system for collecting data from multiple vehicle event recorders. In some embodiments, vehicle data server 104 comprises a system for analyzing vehicle event recorder data. In some embodiments, vehicle data server 104 comprises a system for displaying vehicle event recorder data. In some embodiments, vehicle data server 104 is located at a home station (e.g., a shipping company office, a taxi dispatcher, a truck depot, etc.). In various embodiments, vehicle data server 104 is located at a colocation center (e.g., a center where equipment, space, and bandwidth are available for rental), at a cloud service provider, or any at other appropriate location. In some embodiments, events recorded by vehicle event recorder 102 are downloaded to vehicle data server 104 when vehicle 106 arrives at the home station. In some embodiments, vehicle data server 104 is located at a remote location. In some embodiments, events recorded by vehicle event recorder 102 are downloaded to vehicle data server 104 wirelessly. In some embodiments, a subset of events recorded by vehicle event recorder 102 is downloaded to vehicle data server 104 wirelessly.

Figure 2:
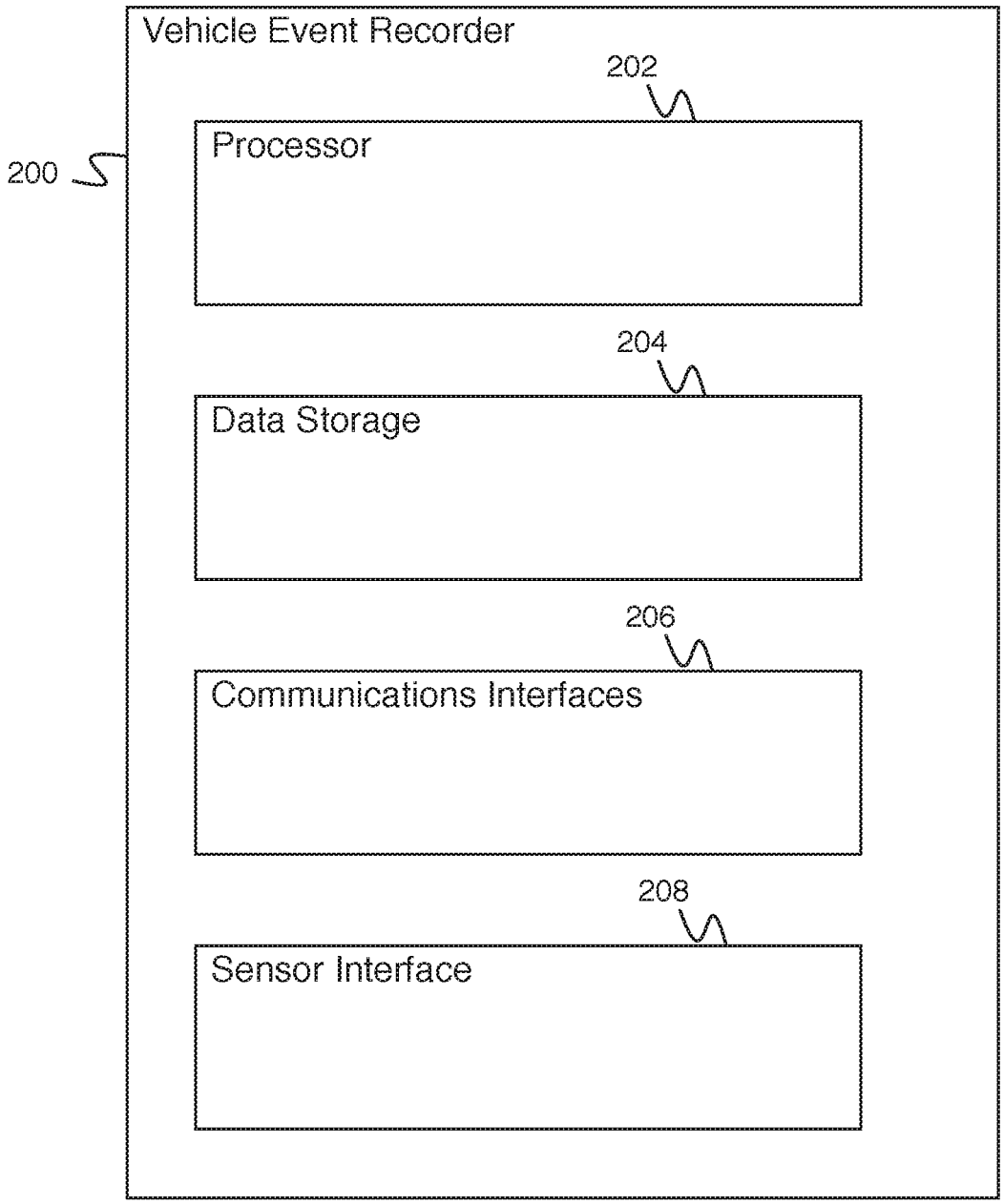
FIG. 2 is a block diagram illustrating an embodiment of a vehicle event recorder.

FIG. 2 is a block diagram illustrating an embodiment of a vehicle event recorder. In some embodiments, vehicle event recorder 200 of FIG. 2 comprises vehicle event recorder 102 of FIG. 1. In the example shown, vehicle event recorder 200 comprises processor 202. Processor 202 comprises a processor for controlling the operations of vehicle event recorder 200, for reading and writing information on data storage 204, for communicating via wireless communications interface 206, and for reading data via sensor interface 208. In various embodiments, processor 202 comprises a processor for determining event(s) using received and/or measured data from sensors, determining vehicle tilt(s), determining a load imbalance factors, determining thresholds for event detection, determining a maintenance item, or for any other appropriate purpose. Data storage 204 comprises a data storage (e.g., a random access memory (RAM), a read only memory (ROM), a nonvolatile memory, a flash memory, a hard disk, or any other appropriate data storage). In various embodiments, data storage 204 comprises a data storage for storing instructions for processor 202, vehicle event recorder data, vehicle event data, sensor data, video data, or any other appropriate data. In various embodiments, communications interfaces 206 comprises one or more of a GSM interface, a CDMA interface, a LTE interface, a UMTS interface, a WiMAX interface, a DSRC interface, a WiFi™ interface, an Ethernet interface, a Universal Serial Bus (USB) interface, a Bluetooth™ interface, an Internet interface, or any other appropriate interface. Sensor interface 208 comprises an interface to one or more vehicle event recorder sensors. In various embodiments, vehicle event recorder sensors comprise an exterior video camera, an exterior still camera, an interior video camera, an interior still camera, a microphone, an accelerometer, a gyroscope, an outdoor temperature sensor, a moisture sensor, a laser line tracker sensor, vehicle state sensors, or any other appropriate sensors. In various embodiments, vehicle state sensors comprise a speedometer, an accelerator pedal sensor, a brake pedal sensor, an engine RPM sensor, an engine temperature sensor, a headlight sensor, an airbag deployment sensor, driver and passenger seat weight sensors, an anti-locking brake sensor, shocks sensors, an engine exhaust sensor, a gear position sensor, a turn signal sensor, a cabin equipment operation sensor, or any other appropriate vehicle state sensors. In some embodiments, sensor interface 208 comprises an on-board diagnostics (OBD) bus (e.g., society of automotive engineers (SAE) J1939, J1708/J1587, OBD-II, CAN BUS, etc.). In some embodiments, vehicle event recorder 200 communicates with vehicle state sensors via the OBD bus. In some embodiments, vehicle event recorder 200 communicates with a vehicle data server via communications interfaces 206. In various embodiments, vehicle event recorder 200 transmits vehicle state sensor data, accelerometer data, speed data, maneuver data, audio data, video data, event data, or any other appropriate data to the vehicle data server.

In some embodiments, vehicle event recorder 200 comprises a system for determining events from data. In some embodiments, vehicle event recorder 200 stores data in a time-delay buffer (e.g., a buffer holding the last 30 seconds of data, the last 5 minutes of data, etc.). In some embodiments, data is deleted from the time-delay buffer after the time-delay period (e.g., a buffer holding the last 30 seconds of data deletes data as soon as it is more than 30 seconds old). In some embodiments, in the event an event is determined from data in the time-delay buffer, data associated with the event is copied from the time-delay buffer into a long-term storage. In various embodiments, event information and associated data is stored, processed, uploaded immediately, uploaded at a later time, provided to an administrator, or handled in any other appropriate way. In some embodiments, data is continually stored (e.g., and not deleted after a time-delay period). In some embodiments, in the event an event is determined from continuously stored data, an event flag is stored associated with the continuously stored data. In some embodiments, data storage is modified based at least in part on an event flag (e.g., data is stored at higher resolution in the vicinity of an event flag). In some embodiments, event data is extracted from continuously stored data. In some embodiments, event data is uploaded (e.g., immediately, at a later time, etc.). In some embodiments, flag data (e.g., an event type, an event severity, etc.) is uploaded. In some embodiments, flag metadata (e.g., a list of flags, a flag identifier, etc.) is uploaded.

Figure 3:
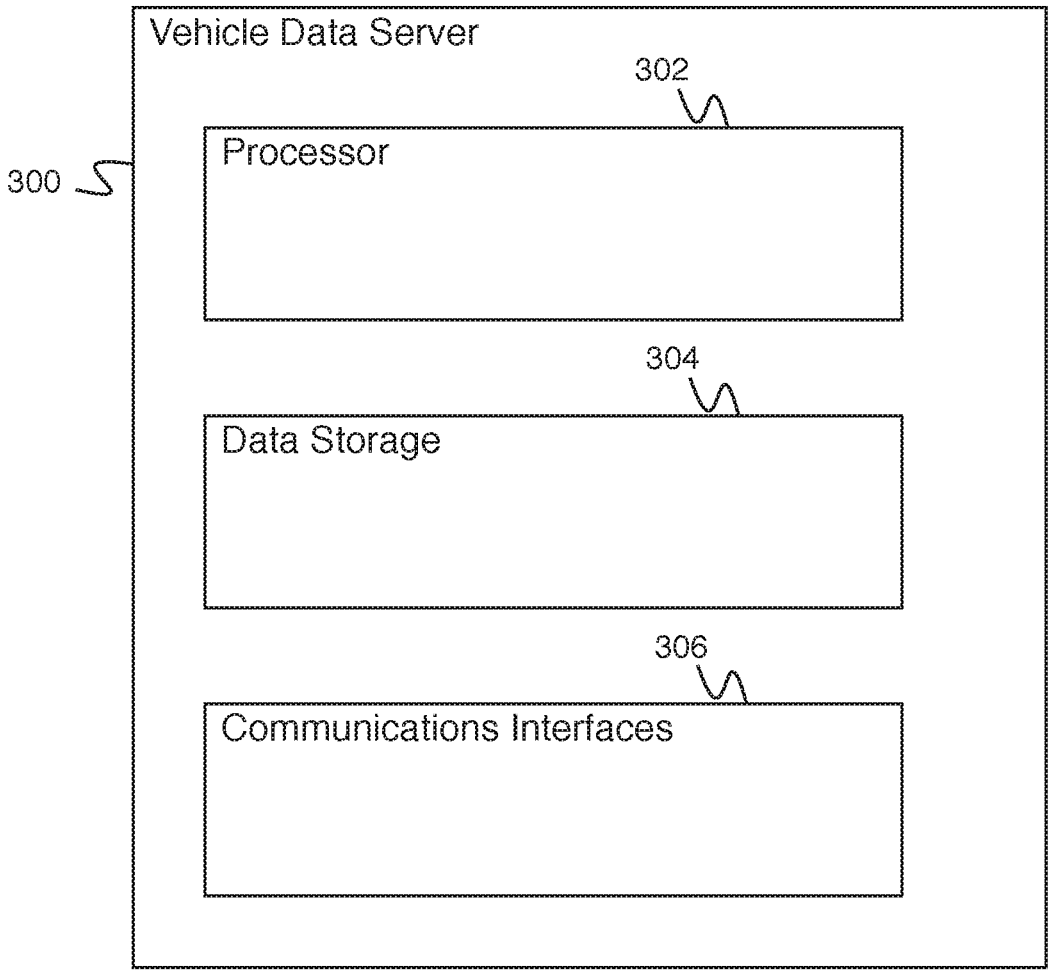
FIG. 3 is a block diagram illustrating an embodiment of a vehicle data server.

FIG. 3 is a block diagram illustrating an embodiment of a vehicle data server. In some embodiments, vehicle data server 300 comprises vehicle data server 104 of FIG. 1. In the example shown, vehicle data server 300 comprises processor 302. In various embodiments, processor 302 comprises a processor for aggregating and analyzing event data, collecting tilt data, determining a loading distributions, or for any other appropriate purpose. Data storage 304 comprises a data storage (e.g., a random access memory (RAM), a read only memory (ROM), a nonvolatile memory, a flash memory, a hard disk, or any other appropriate data storage). In various embodiments, data storage 304 comprises a data storage for storing instructions for processor 302, vehicle event recorder data, vehicle event data, sensor data, video data, map data, machine learning algorithm data, or any other appropriate data. In various embodiments, communications interfaces 306 comprises one or more of a GSM interface, a CDMA interface, a LTE interface, a UMTS interface, a WiMAX interface, a DSRC interface, a WiFi™ interface, an Ethernet interface, USB interface, a Bluetooth™ interface, an Internet interface, a fiber optic interface, or any other appropriate interface. In various embodiments, vehicle data server 300 receives events, maneuvers, data, or any other appropriate information from one or more vehicle event recorders.

Figure 4:
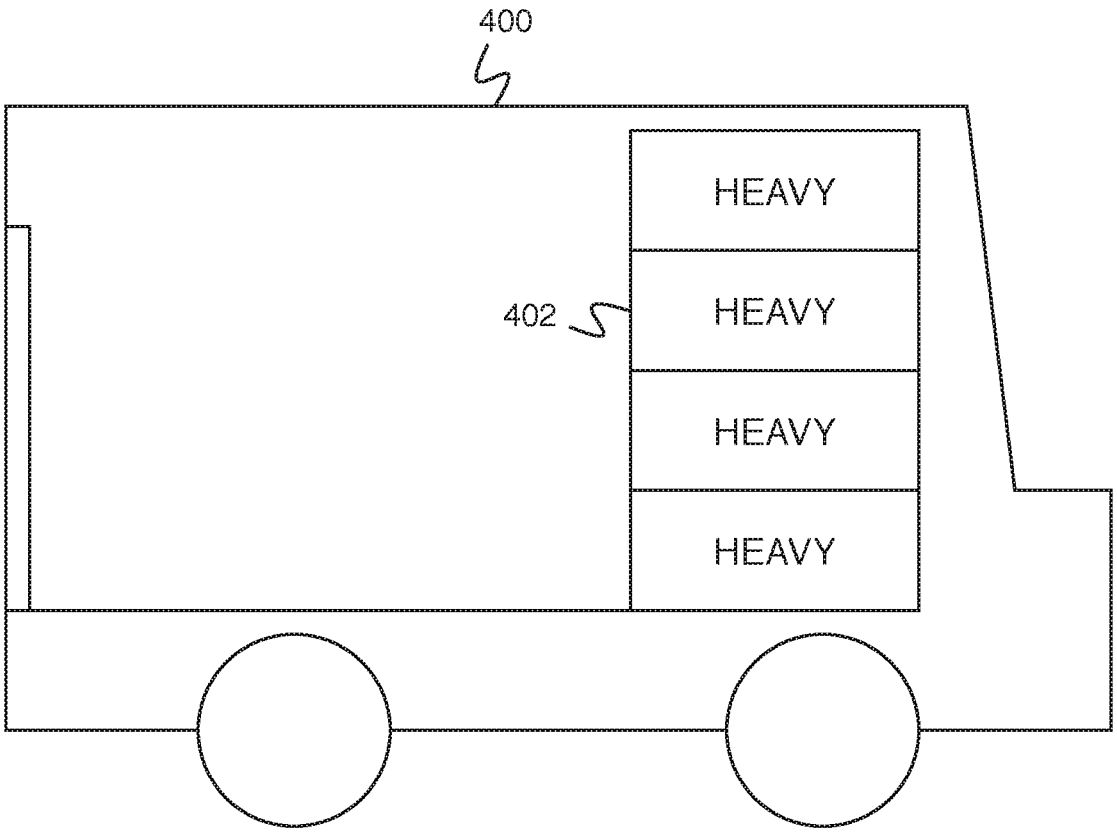
FIG. 4 is a diagram illustrating an embodiment of a cutaway side view of a loaded delivery vehicle.

FIG. 4 is a diagram illustrating an embodiment of a cutaway side view of a loaded delivery vehicle. In some embodiments, vehicle 400 comprises vehicle 106 of FIG. 1. In the example shown, vehicle 400 comprises a delivery vehicle for delivering cargo with a vehicle event recorder mounted within it for determining vehicle information. The vehicle event recorder has a system that enables the determination of an estimation of a center of gravity. In the example shown, vehicle 400 is loaded with heavy boxes 402. Heavy boxes 402 are loaded with a high and forward center of gravity. When vehicle 400 executes a stopping maneuver, the high and forward center of gravity of loading causes it to tilt forward more than it would in the event boxes 402 are loaded with a lower and balanced center of gravity. In some embodiments, a system for center of gravity estimation determines that the center of gravity is a higher and more forward compared to an unloaded center of gravity based at least in part on sensor measurements (e.g., accelerometer measurements, gyro measurements, shocks measurements, external facing camera measurements, etc.).

Figure 5A:
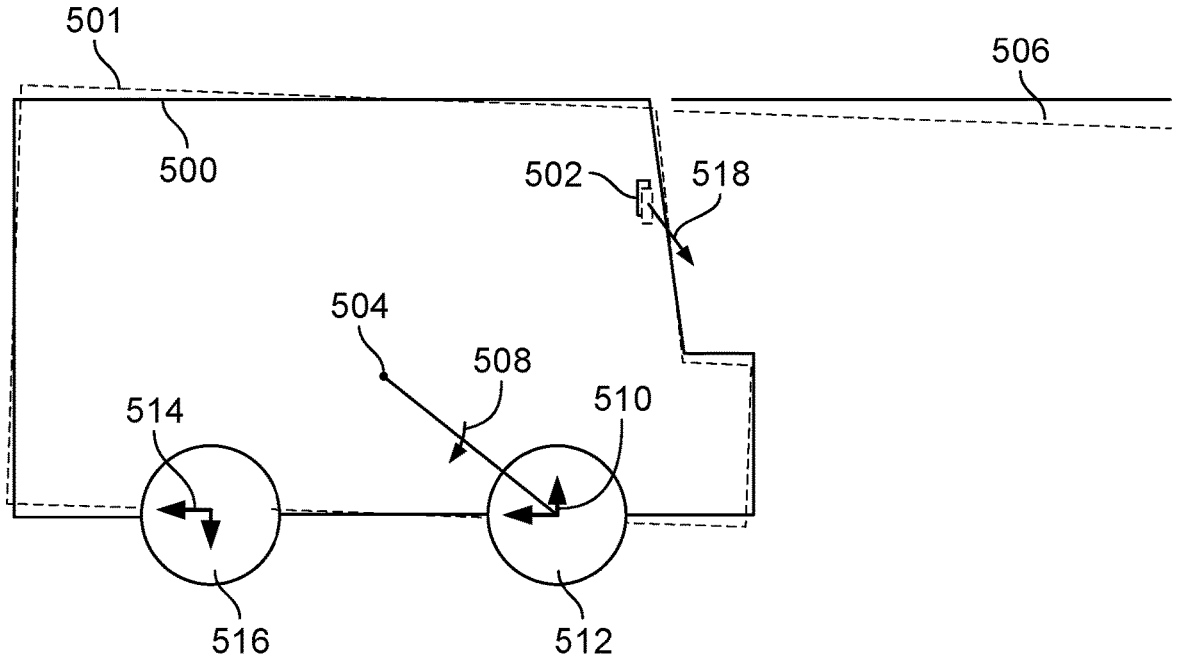
FIG. 5A is a diagram illustrating an embodiment of a vehicle tilting during a stopping maneuver.

FIG. 5A is a diagram illustrating an embodiment of a vehicle tilting during a stopping maneuver. In some embodiments, vehicle 500 comprises vehicle 400 of FIG. 4 in an unloaded state. In the example shown, vehicle 500 is tilting forward (e.g., dotted vehicle outline 501 is tilted forward as compared to solid line of vehicle 500) as it performs a stopping maneuver. Vehicle event recorder 502 is mounted on vehicle 500 and tilts with vehicle 500. The forward tilt angle 506 of unloaded vehicle 500 is measured as vehicle 500 performs a stopping maneuver and stored as a function of braking force. In some embodiments, a model is generated and stored that outputs forward tilt angle 506 for a given brake force applied (e.g., where the brake force is provided as a sensor data input to vehicle event recorder 502). In some embodiments, vehicle 500 is determined to be unloaded using data input to the vehicle event recorder 502 (e.g., input manually, input by measuring stopping maneuvers when unloaded where unloaded is determined using vehicle sensors—for example, shock loading sensors, interior camera sensors, etc.). Forward tilt angle 506 is a measure of rotation 508 about center of mass 504 of vehicle 500 due to torques. Rotation 508 stabilizes when braking torque 512 equals or balances out shock/spring torque 510 at the front wheel and when braking torque 514 equals or balances out shock/spring torque 516 at the back wheel. Vehicle event recorder 502 experiences angular acceleration 518 around center of mass 504 initially in the direction of forward tilt angle 506, which reverses as forward tilt angle 506 stabilizes to its maximum. Forward tilt angle 506 is also measurable using a forward facing camera measuring the motion of the image (e.g., using horizon position change, hood position change, etc.). In various embodiments, forward tilt angle 506 is measured using an accelerometer, is measured directly from sensors mounted on vehicle shocks, is measured using a gyro, is measured using an external-facing camera, or is measured in any other appropriate way.

Figure 5B:
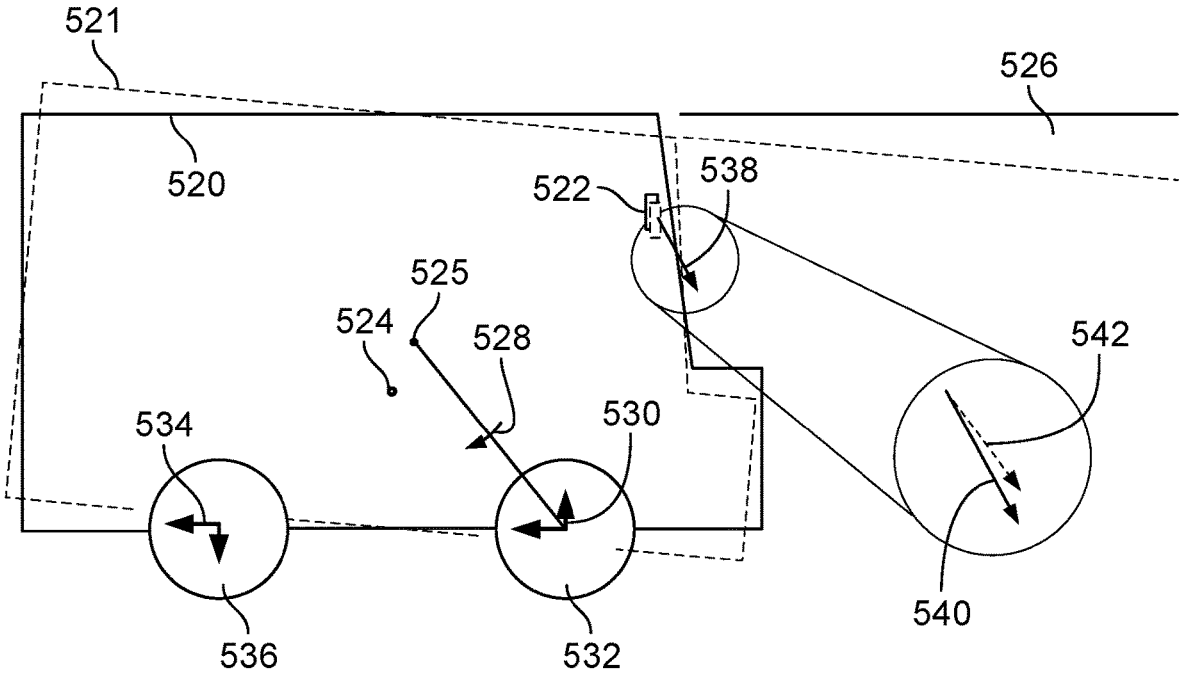
FIG. 5B is a diagram illustrating an embodiment of a vehicle tilting during a stopping maneuver.

FIG. 5B is a diagram illustrating an embodiment of a vehicle tilting during a stopping maneuver. In some embodiments, vehicle 520 comprises vehicle 400 of FIG. 4 in an imbalanced loaded state. In the example shown, vehicle 520 is tilting forward (e.g., dotted vehicle outline 521 is tilted forward as compared to solid line of vehicle 520) as it performs a stopping maneuver and tilts at a different angle due to the loading. Vehicle event recorder 522 is mounted on vehicle 520 and tilts with vehicle 520. The forward tilt angle 526 of loaded vehicle 520 is measured as vehicle 520 performs a stopping maneuver and stored as a function of braking force. In some embodiments, a model is generated and stored that outputs forward tilt angle 526 for a given brake force applied (e.g., where the brake force is provided as a sensor data input to vehicle event recorder 522). In some embodiments, vehicle 520 is determined to be unloaded using data input to the vehicle event recorder 522 (e.g., input manually, input by measuring stopping maneuvers when unloaded where unloaded is determined using vehicle sensors—for example, shock loading sensors, interior camera sensors, etc.). Forward tilt angle 526 is a measure of rotation 528 about center of mass 525 of vehicle 520 due to torques, where center of mass 525 has moved due to vehicle loading from unloaded center of mass 524 to a different position (e.g., higher and more forward in vehicle 520 in FIG. 5B). Rotation 528 stabilizes when braking torque 532 equals or balances out shock/spring torque 530 at the front wheel and when braking torque 534 equals or balances out shock/spring torque 536 at the back wheel. Vehicle event recorder 522 experiences angular acceleration 538 around center of mass 525 initially in the direction of forward tilt angle 526, which reverses as forward tilt angle 526 stabilizes to its maximum. Forward tilt angle 526 is also measurable using a forward facing camera measuring the motion of the image (e.g., using horizon position change, hood position change, etc.). In various embodiments, forward tilt angle 526 is measured using an accelerometer, is measured directly from sensors mounted on vehicle shocks, is measured using a gyro, is measured using an external-facing camera, or is measured in any other appropriate way. Detail view of angular acceleration 538 shows angular acceleration 540 (corresponding to angular acceleration 538) of loaded vehicle 520 and its difference to angular acceleration 542 of unloaded vehicle (e.g., in this case at a greater tilt angle and greater magnitude).

Figure 6:
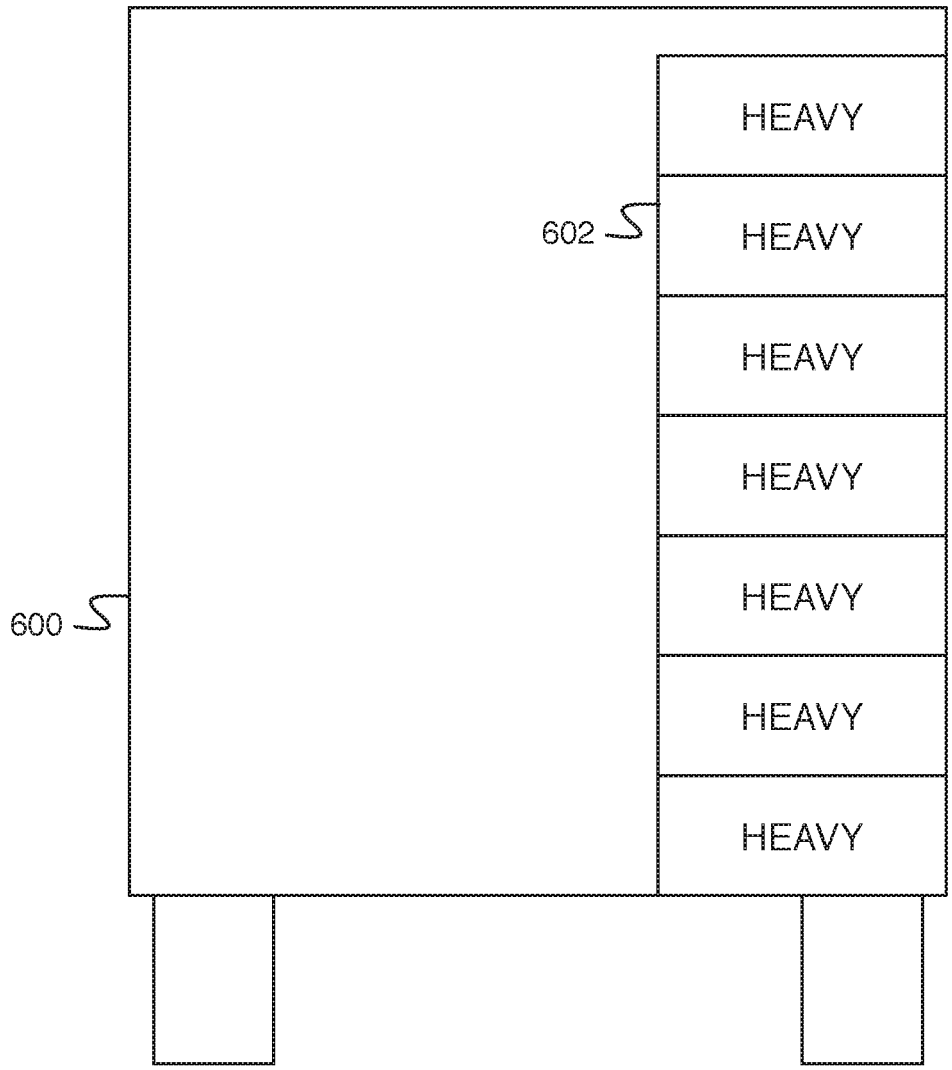
FIG. 6 is a diagram illustrating an embodiment of a rear cutaway view of a loaded delivery vehicle.

FIG. 6 is a diagram illustrating an embodiment of a rear cutaway view of a loaded delivery vehicle. In some embodiments, vehicle 600 comprises vehicle 106 of FIG. 1. In the example shown, vehicle 600 comprises a delivery vehicle for delivering cargo with a vehicle event recorder mounted within it for determining vehicle information. The vehicle event recorder has a system that enables the determination of an estimation of a center of gravity. In the example shown, vehicle 600 is loaded with heavy boxes 602. Heavy boxes 602 are loaded with a high center of gravity and biased towards the right side of vehicle 600. When vehicle 600 executes a turning maneuver, the imbalanced loading causes it to tilt to the right more than it would in the event boxes 602 were loaded with a lower and balanced center of gravity. In some embodiments, a system for center of gravity estimation determines that the center of gravity is higher and to the right of center based at least in part on sensor measurements (e.g., accelerometer measurements, gyro measurements, shocks measurements, external facing camera measurements).

Figure 7A:
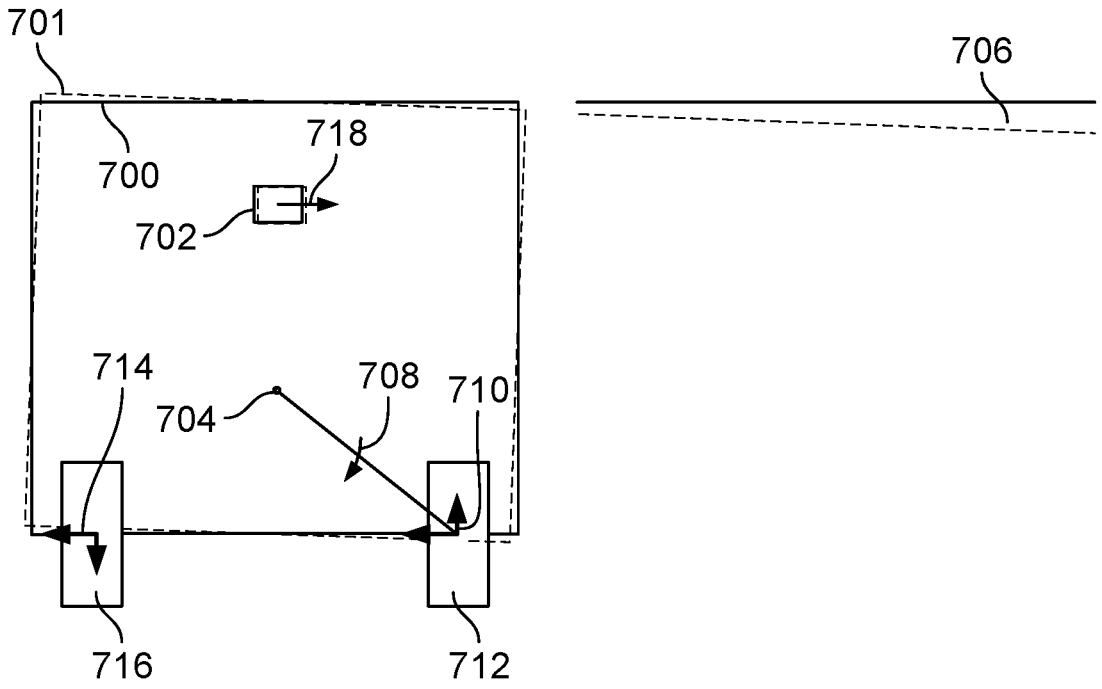
FIG. 7A is a diagram illustrating an embodiment of a vehicle tilting during a turning maneuver.

FIG. 7A is a diagram illustrating an embodiment of a vehicle tilting during a turning maneuver. In some embodiments, vehicle 700 comprises vehicle 600 of FIG. 6 in an unloaded state. In the example shown, vehicle 700 is tilting to the side (e.g., dotted vehicle outline 701 is tilted to the side as compared to solid line of vehicle 700) as it performs a turning maneuver. Vehicle event recorder 702 is mounted on vehicle 700 and tilts with vehicle 700. The side tilt angle 706 of unloaded vehicle 700 is measured as vehicle 700 performs a turning maneuver and stored as a function of turning force. In some embodiments, a model is generated and stored that outputs side tilt angle 706 for a given turning force applied (e.g., where the turning force is provided as a sensor data to vehicle event recorder 702). In some embodiments, vehicle 700 is determined to be unloaded using data input to the vehicle event recorder 702 (e.g., input manually, input by measuring turning maneuvers when unloaded where unloaded is determined using vehicle sensors—for example, gyroscope sensors, interior camera sensors, etc.). Side tilt angle 706 is a measure of rotation 708 about center of mass 704 of vehicle 700 due to torques. Rotation 708 stabilizes when turning torque 712 equals or balances out shock/spring torque 710 at the front wheel and when turning torque 714 equals or balances out shock/spring torque 716 at the back wheel. Vehicle event recorder 702 experiences angular acceleration 718 around center of mass 704 initially in the direction of side tilt angle 706, which reverses as side tilt angle 706 stabilizes to its maximum. Side tilt angle 706 is also measurable using a forward facing camera measuring the motion of the image (e.g., using horizon position change, hood position change, etc.). In various embodiments, side tilt angle 706 is measured using an accelerometer, is measured directly from sensors mounted on vehicle shocks, is measured using a gyro, is measured using an external-facing camera, or is measured in any other appropriate way.

Figure 7B:
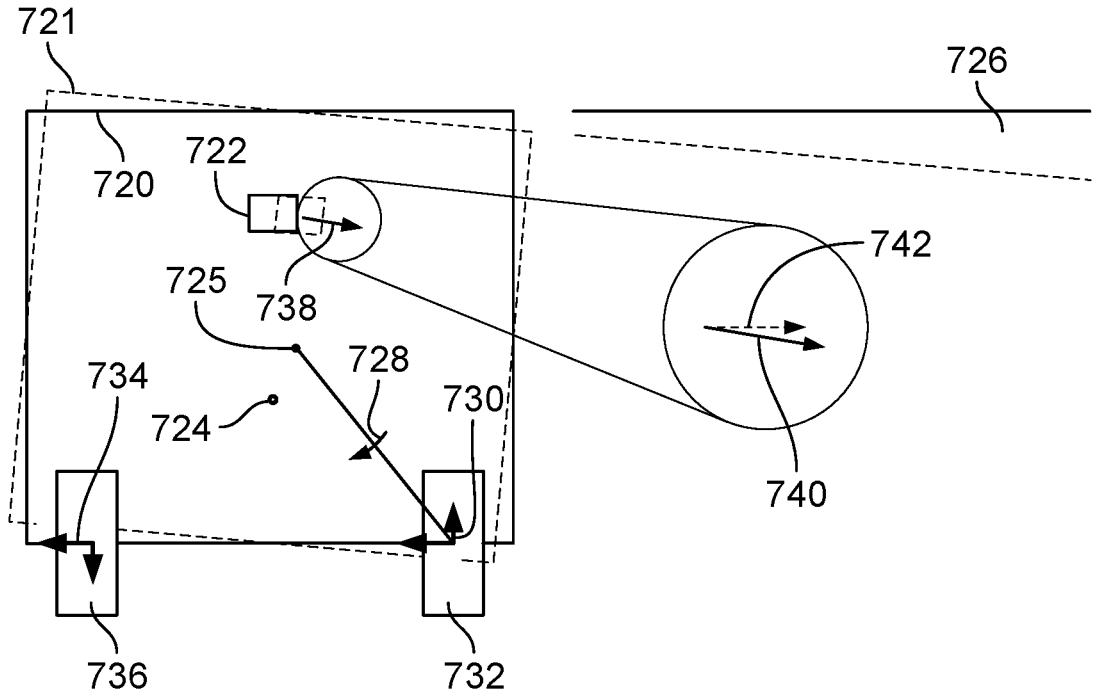
FIG. 7B is a diagram illustrating an embodiment of a vehicle tilting during a turning maneuver.

FIG. 7B is a diagram illustrating an embodiment of a vehicle tilting during a turning maneuver. In some embodiments, vehicle 720 comprises vehicle 600 of FIG. 6 in an imbalanced loaded state. In the example shown, vehicle 720 is tilting to the side (e.g., dotted vehicle outline 721 is tilted to the side as compared to solid line of vehicle 720) as it performs a turning maneuver and tilts at a different angle due to the loading. Vehicle event recorder 722 is mounted on vehicle 720 and tilts with vehicle 720. The side tilt angle 726 of loaded vehicle 720 is measured as vehicle 720 performs a turning maneuver and stored as a function of turning force. In some embodiments, a model is generated and stored that outputs side tilt angle 726 for a given turning force applied (e.g., where the turning force is provided as a sensor data input to vehicle event recorder 722). In some embodiments, vehicle 720 is determined to be unloaded using data input to the vehicle event recorder 722 (e.g., input manually, input by measuring turning maneuvers when unloaded where unloaded is determined using vehicle sensors—for example, shock loading sensors, interior camera sensors, etc.). Side tilt angle 726 is a measure of rotation 728 about center of mass 725 of vehicle 720 due to torques, where center of mass 725 has moved due to vehicle loading from unloaded center of mass 724 to a different position (e.g., higher and to the right in vehicle 720 in FIG. 7B). Rotation 728 stabilizes when turning torque 732 equals or balances out shock/spring torque 730 at the front wheel and when turning torque 734 equals or balances out shock/spring torque 736 at the back wheel. Vehicle event recorder 722 experiences angular acceleration 738 around center of mass 725 initially in the direction of side tilt angle 726, which reverses as side tilt angle 726 stabilizes to its maximum. Side tilt angle 726 is also measurable using a forward facing camera measuring the motion of the image (e.g., using horizon position change, hood position change, etc.). In various embodiments, side tilt angle 726 is measured using an accelerometer, is measured directly from sensors mounted on vehicle shocks, is measured using a gyro, is measured using an external-facing camera, or is measured in any other appropriate way. Detail view of angular acceleration 738 shows angular acceleration 740 (corresponding to angular acceleration 738) of loaded vehicle 720 and its difference to angular acceleration 742 of unloaded vehicle (e.g., in this case at a greater tilt angle and greater magnitude).

Figure 8A:
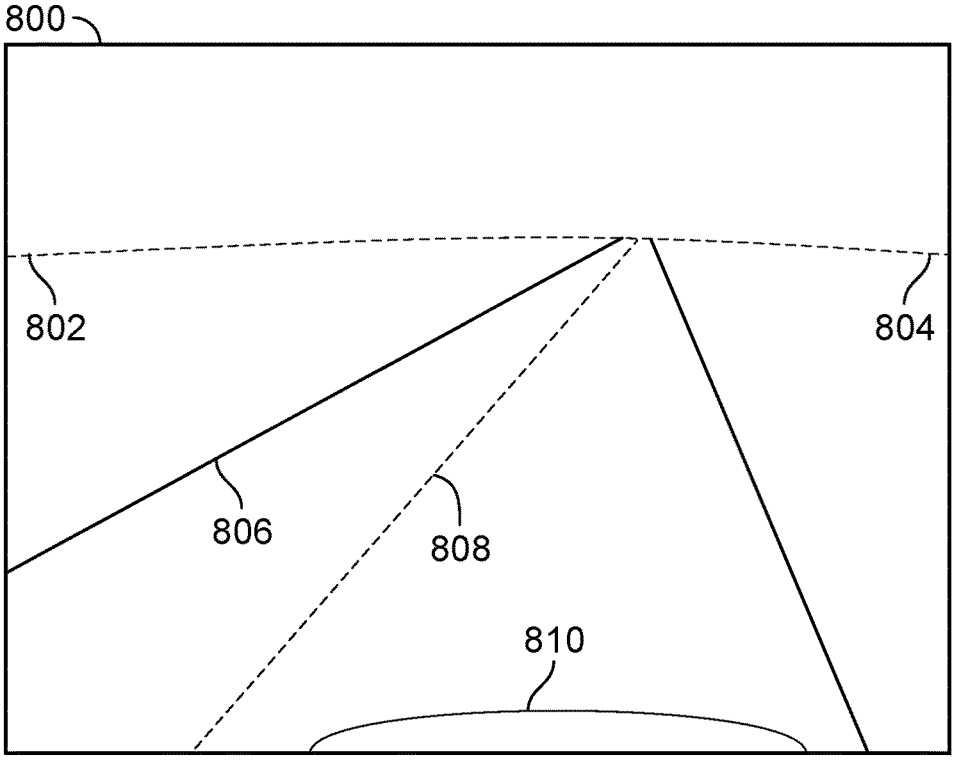
FIG. 8A is a diagram illustrating an embodiment of a view from an outward facing camera.

FIG. 8A is a diagram illustrating an embodiment of a view from an outward facing camera. In some embodiments, the view of FIG. 8A comprises a view from a forward or outward facing camera mounted on a vehicle that is a part of a vehicle event recorder (e.g., vehicle 106 of FIG. 1). In the example shown, view 800 comprises a typical view from the outward facing camera depicting road 806 with centerline 808 and with hood line 810 when the vehicle is traveling. Left horizon point 802 (e.g., the point where the horizon crosses the left edge of the view) and right horizon point 804 (e.g., the point where the horizon crosses the right edge of the view) can be determined from view 800.

Figure 8B:
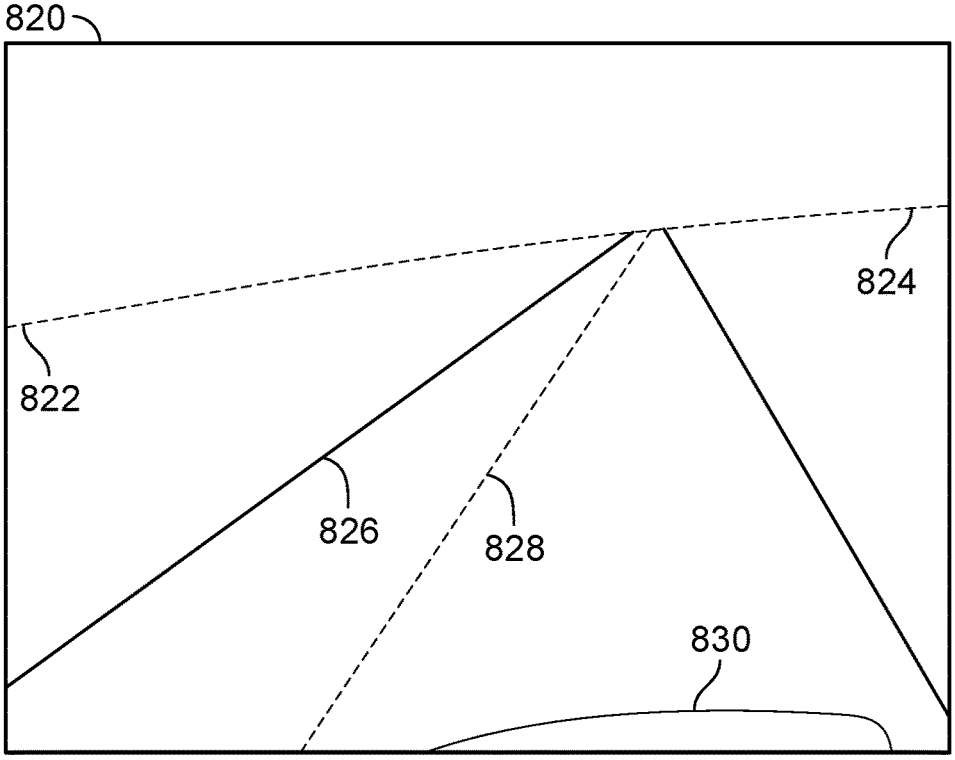
FIG. 8B is a diagram illustrating an embodiment of a view from an outward facing camera.

FIG. 8B is a diagram illustrating an embodiment of a view from an outward facing camera. In some embodiments, the views of FIG. 8B comprises a view from a forward or outward facing camera mounted on a vehicle that is a part of a vehicle event recorder (e.g., vehicle 106 of FIG. 1). In the example shown, view 820 comprises a typical view from the outward facing camera depicting road 826 with centerline 828 and with hood line 830 when the vehicle is turning sharply to the left. Left horizon point 822 (e.g., the point where the horizon crosses the left edge of the view) and right horizon point 824 (e.g., the point where the horizon crosses the right edge of the view) can be determined from view 820. In the example shown, the left turn is sharp enough such that the vehicle tilts to the right. Left horizon point 822 and right horizon point 824 can be captured from view 820. Left horizon point 822 is lower in view 820 than it is in view 800 and right horizon point 824 is higher in view 820 than it is in view 800 of FIG. 8A. The horizon point shift of view 820 as compared with view 800 of FIG. 8A can be used to identify view 820 as having been taken during a sharp left turn.

Figure 8C:
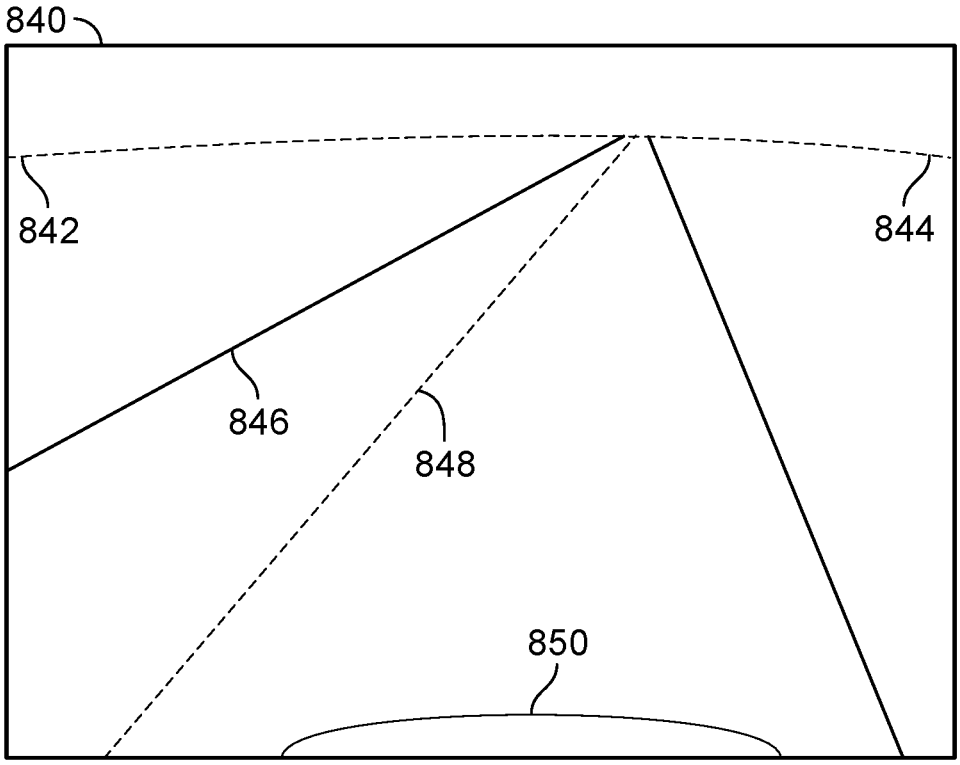
FIG. 8C is a diagram illustrating an embodiment of a view from an outward facing camera.

FIG. 8C is a diagram illustrating an embodiment of a view from an outward facing camera. In some embodiments, the views of FIG. 8C comprises a view from a forward or outward facing camera mounted on a vehicle that is a part of a vehicle event recorder (e.g., vehicle 106 of FIG. 1). In the example shown, view 840 comprises a typical view from the outward facing camera depicting road 846 with centerline 848 and with hood line 850 when the vehicle is stopping suddenly. Left horizon point 842 (e.g., the point where the horizon crosses the left edge of the view) and right horizon point 844 (e.g., the point where the horizon crosses the right edge of the view) can be determined from view 840. View 840 comprises a view from the outward facing camera during a hard stop. The stop is hard enough that the vehicle tilts forward. Left horizon point 842 and right horizon point 844 can be captured from view 840. Left horizon point 842 and right horizon point 844 are both higher in view 840 than they are in view 800 of FIG. 8A. The horizon point shift in view 840 as compared with view 800 can be used to identify view 840 as having been taken during a hard stop.

Figure 9:
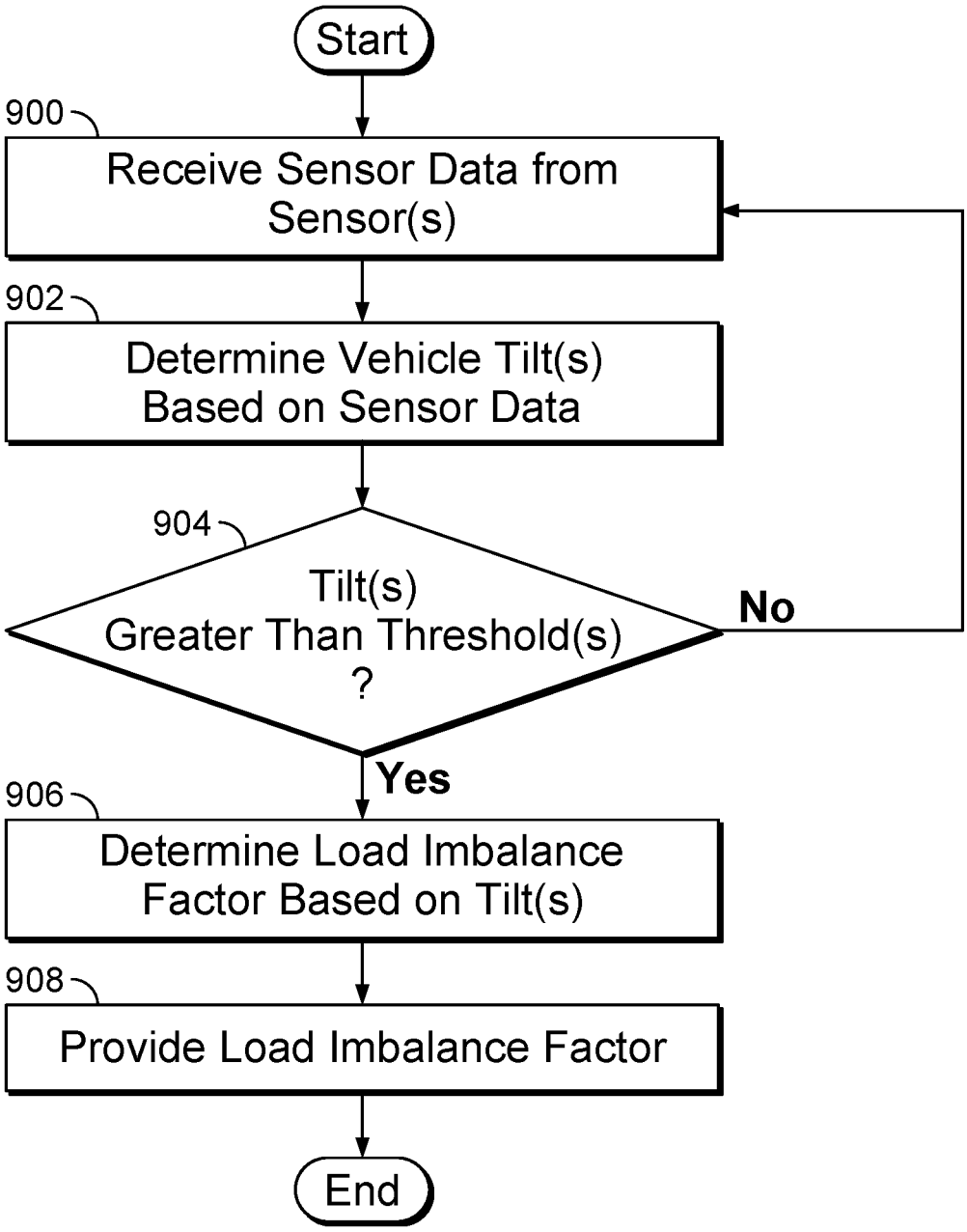
FIG. 9 is a flow diagram illustrating an embodiment of a process for determining a load imbalance factor.

FIG. 9 is a flow diagram illustrating an embodiment of a process for determining a load imbalance factor. In some embodiments, the process of FIG. 9 comprises a process for determining a center of gravity. In some embodiments, the process of FIG. 9 is executed by a vehicle event recorder (e.g., vehicle event recorder 102 of FIG. 1). In the example shown, in 900, sensor data is received from sensor(s). For example, sensor data is received from vehicle event recorder sensors or vehicle sensors at a processor of the vehicle event recorder. In various embodiments, sensors comprise one or more accelerometers, gyros, shocks sensors, speed sensors, outward-facing cameras, or any other appropriate sensors. In 902, vehicle tilt(s) is/are determined based on the sensor data. For example, the sensor data is analyzed to determine vehicle tilts (e.g., using image data, accelerometer data, shock data, brake data, gyroscopic data, etc.). In some embodiments, the one or more vehicle tilts comprise a forward tilt and/or a lateral tilt. In 904, it is determined whether tilt(s) is/are greater than one or more thresholds. For example, the tilt(s) is/are compared to one or more thresholds to determine whether the tilt(s) is/are significant. In the event that the tilt(s) is/are not greater than one or more thresholds, then control passes to 900. In the event that the tilt(s) is/are greater than one or more thresholds, then control passes to 906. In 906, a load imbalance factor is determined based on the one or more tilts. For example, a determination of the center of mass or center of gravity of the vehicle is determined associated with a loaded and unloaded vehicle based on the tilts. In some embodiments, the center of mass or center of gravity difference between the loaded and unloaded vehicle is then used to determine a load imbalance factor. In some embodiments, the center of mass or center of gravity difference between a correctly loaded and an improperly loaded vehicle is then used to determine a load imbalance factor. In various embodiments, an unloaded vehicle is determined by averaging a performance of the vehicle during maneuvers after unloading, when loaded below a threshold, on return trip to the dispatch center, when an image information indicates an unloaded condition, or any other appropriate manner of determining an unloaded vehicle. In various embodiments, a correctly loaded vehicle is determined by averaging a performance of the vehicle during maneuvers after correctly loading, when an image information indicates a properly loaded condition, or any other appropriate manner of determining a correctly loaded vehicle. In some embodiments, a load imbalance factor is based at least in part on one or more characteristic tilts (e.g., tilts associated with an unloaded vehicle). In 908, the load imbalance factor is provided. In some embodiments, the load imbalance factor is provided for storage (e.g., for storage on the vehicle event recorder, for storage on a vehicle data server, etc.). In some embodiments, one or more event detection thresholds (e.g., a sharp turn speed risk threshold) are updated based at least in part on the load imbalance factor. In some embodiments, a vehicle loading profile is determined based at least in part on the one or more tilts. In various embodiments, a vehicle loading profile comprises an empty vehicle loading profile, a correctly loaded vehicle loading profile, a top loaded vehicle loading profile, a side loaded vehicle loading profile, or any other appropriate vehicle loading profile. In some embodiments, the vehicle loading profile is provided for storage (e.g., provided for storage by the vehicle event recorder, by a vehicle data server, etc.). In some embodiments, vehicle maintenance information is determined based at least in part on one or more load imbalance factor values (e.g., in the event historical load imbalance factor data trends toward a load imbalance with a particular bias, the problem may be with the vehicle rather than with the loading, and vehicle maintenance information can be determined to investigate and/or address the problem). In some embodiments, load imbalance factor is provided to a driver—for example, a notification of load imbalance (e.g., an indicator light, a text indication, a graphic indication, etc.) is provided to the driver so that the driver can redistribute their load. In some embodiments, a driver is provided information as to which side (e.g., front, back, left side, right side, top, etc.) is over weighted.

Figure 10:
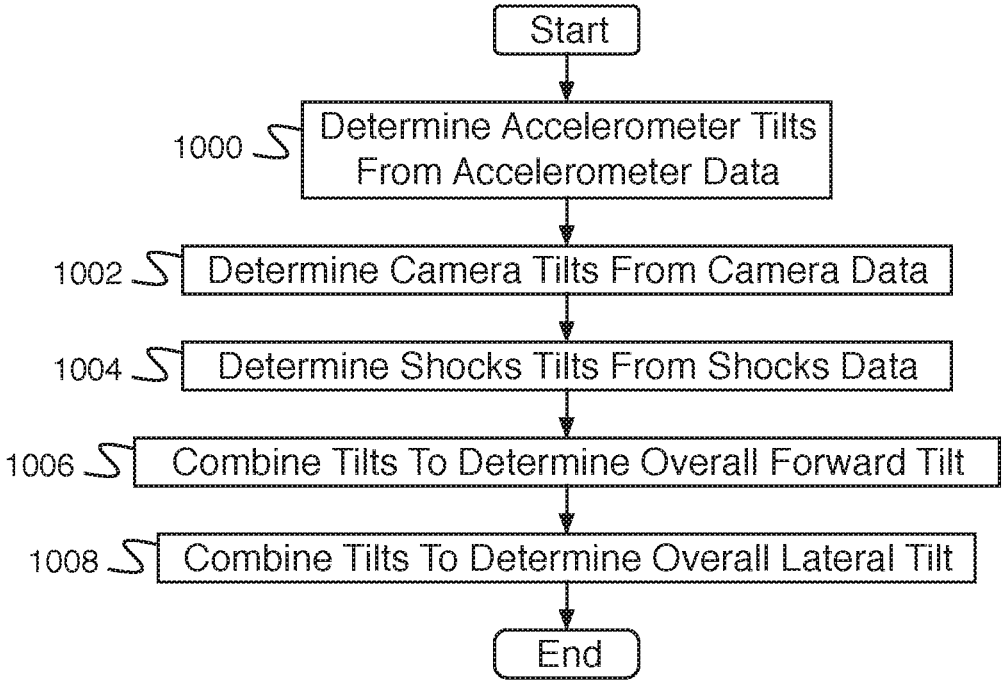
FIG. 10 is a flow diagram illustrating an embodiment of a process for determining one or more vehicle tilts based at least in part on sensor data.

FIG. 10 is a flow diagram illustrating an embodiment of a process for determining one or more vehicle tilts based at least in part on sensor data. In some embodiments, the process of FIG. 10 implements 902 of FIG. 9. In the example shown, forward tilt and lateral tilt are determined from accelerometer data, camera data, and/or shocks data. In some embodiments, tilts are determined during a vehicle maneuver (e.g., a stopping maneuver, a cornering maneuver, etc.). In various embodiments, tilts comprise peak tilts during the maneuver, average tilts during the maneuver, tilts along the maneuver path, or any other appropriate tilts. In 1000, accelerometer tilts are determined from accelerometer data. In some embodiments, accelerometer tilts are determined by calculating the angular difference between a calculated or unloaded overall acceleration applied to the accelerometer and a measured or loaded overall acceleration applied to the accelerometer. In some embodiments, a forward tilt and a lateral tilt are determined by separating the forward and lateral angular differences between the calculated or unloaded overall acceleration applied to the accelerometer and the measured or loaded overall acceleration applied to the accelerometer. In 1002, camera tilts are determined from camera data. In some embodiments, camera tilts are determined from a combination of horizon point shifts as observed by a forward facing camera. In 1004, shocks tilts are determined from shocks data. In some embodiments, shocks data comprises a set of measurements describing shocks compression on each of the vehicle wheels. In some embodiments, shocks tilts can be determined directly from shocks data. In some embodiments, determining shocks tilts from shocks data requires calibration information (e.g., shocks compression information for an unloaded vehicle). In 1006, tilts are combined to determine an overall forward tilt. In 1008, tilts are combined to determine an overall forward tilt. In various embodiments, tilts are combined by determining the average, determining the median, removing an outlier and determining the average, or combining in any other appropriate way.

Figure 11:
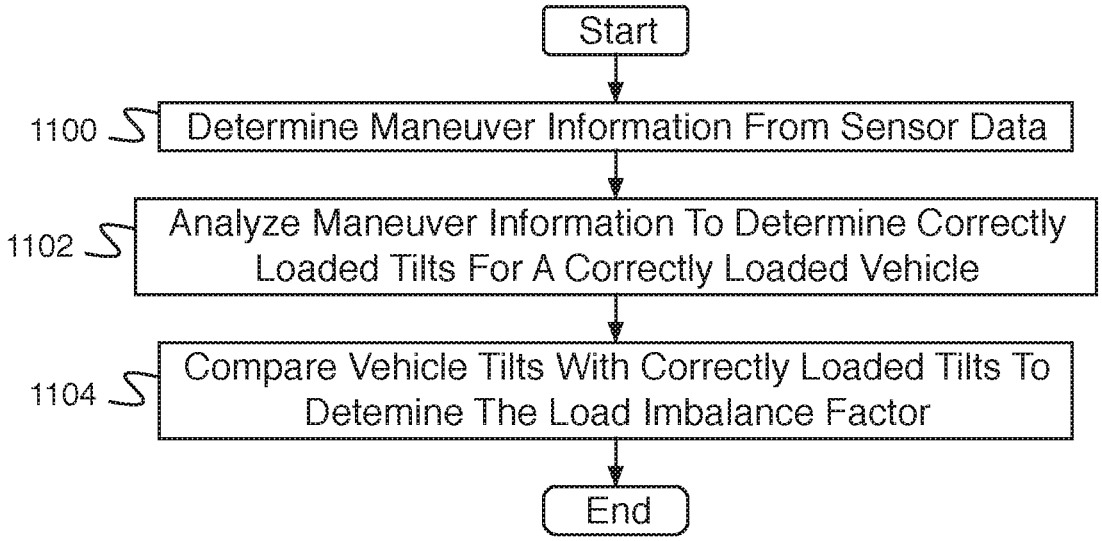
FIG. 11 is a flow diagram illustrating an embodiment of a process for determining a load imbalance factor based at least in part on one or more vehicle tilts.

FIG. 11 is a flow diagram illustrating an embodiment of a process for determining a load imbalance factor based at least in part on one or more vehicle tilts. In some embodiments, the process of FIG. 11 implements 906 of FIG. 9. In the example shown, in 1100, maneuver information is determined from sensor data. In various embodiments, maneuver information comprises a maneuver type, a maneuver rate, a maneuver path, or any other appropriate maneuver information. In 1102, maneuver information is analyzed to determine correctly loaded tilts for a correctly loaded vehicle. In various embodiments, correctly loaded tilts comprise peak correctly loaded tilts during the maneuver, average correctly loaded tilts during the maneuver, correctly loaded tilts along the maneuver path, or any other appropriate correctly loaded tilts. In 1104 vehicle tilts are compared with correctly loaded tilts to determine the load imbalance factor. In some embodiments, the load imbalance factor comprises the ratio of the vehicle tilts to the correctly loaded tilts.

Figure 12:
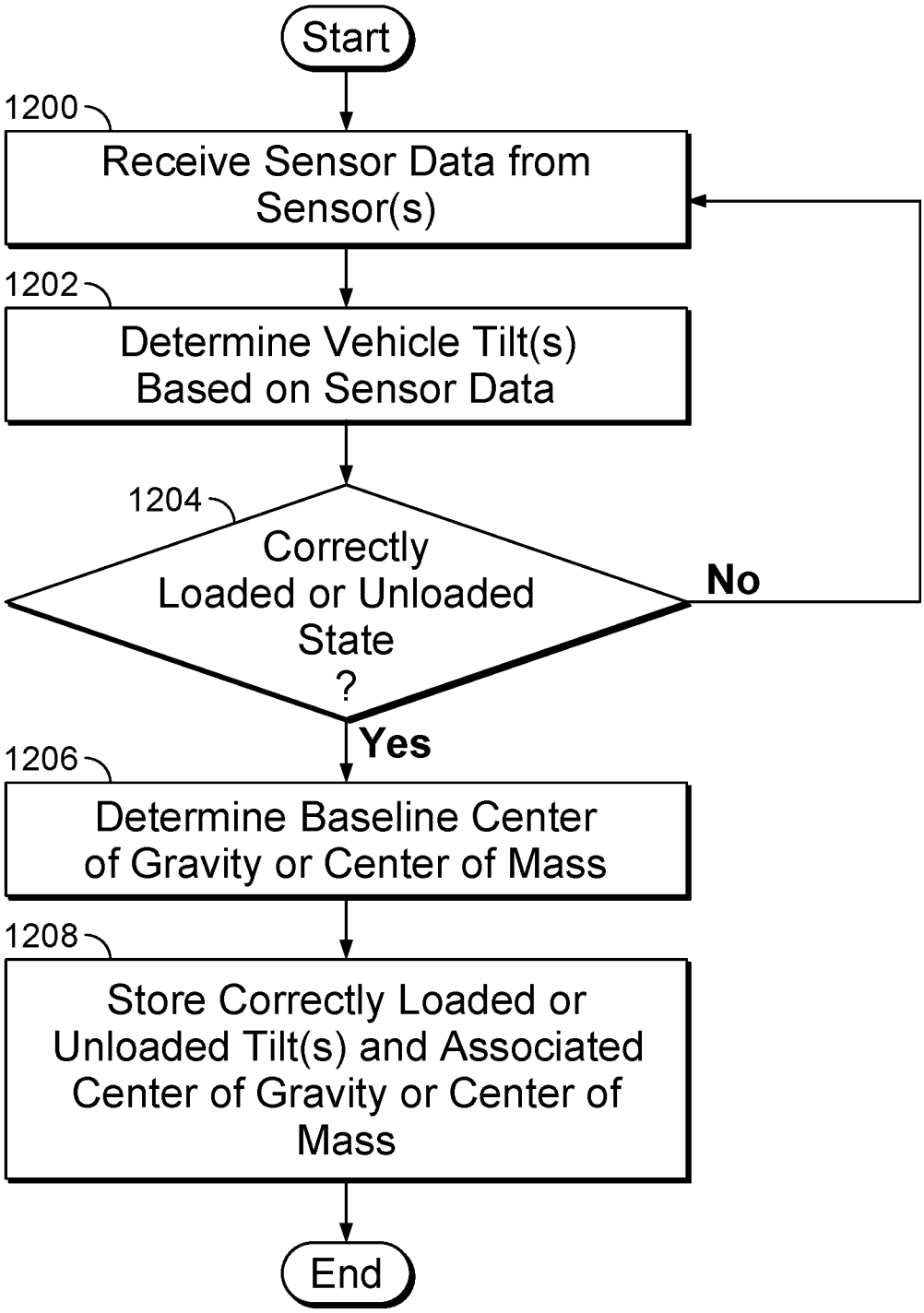
FIG. 12 is a flow diagram illustrating an embodiment of a process for determining baseline center of gravity or center of mass associated with correctly loaded or unloaded vehicle states.

FIG. 12 is a flow diagram illustrating an embodiment of a process for determining baseline center of gravity or center of mass associated with correctly loaded or unloaded vehicle states. In some embodiments, the process of FIG. 12 is executed by a vehicle event recorder (e.g., vehicle event recorder 102 of FIG. 1). In the example shown, in 1200, sensor data is received from sensor(s). For example, sensor data is received from vehicle event recorder sensors or vehicle sensors at a processor of the vehicle event recorder. In various embodiments, sensors comprise one or more accelerometers, gyros, shocks sensors, speed sensors, outward-facing cameras, or any other appropriate sensors. In 1202, vehicle tilt(s) is/are determined based on the sensor data. For example, the sensor data is analyzed to determine vehicle tilts (e.g., using image data, accelerometer data, shock data, brake data, gyroscopic data, etc.). In some embodiments, the one or more vehicle tilts comprise a forward tilt and/or a lateral tilt. In 1204, it is determined whether the vehicle is in a correctly loaded or unloaded state. For example, using the sensor data a state is associated with the data (e.g., correctly loaded or unloaded states using image data, using shock loading data, etc.). In the event that the vehicle is not in a correctly loaded or unloaded state, then control passes to 1200. In the event that the vehicle is in a correctly loaded or unloaded state, then control passes to 1206. In 1206, a baseline center of gravity or center of mass is determined. For example, a determination of the center of mass or center of gravity of the vehicle is determined associated with a loaded and unloaded vehicle based on the tilts. In some embodiments, the center of mass or center of gravity difference between the loaded and unloaded vehicle is then used to determine a load imbalance factor. In various embodiments, an unloaded vehicle is determined by averaging a performance of the vehicle during maneuvers after unloading, when loaded below a threshold, on return trip to the dispatch center, when an image information indicates an unloaded condition, or any other appropriate manner of determining an unloaded vehicle. In various embodiments, a correctly loaded vehicle is determined by averaging a performance of the vehicle during maneuvers after correctly loading, when an image information indicates a properly loaded condition, or any other appropriate manner of determining a correctly loaded vehicle. In 1208, correctly loaded or unloaded tilts and associated center of gravity or center of mass are stored.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for determining a load imbalance factor of a vehicle, comprising:

a memory coupled to a processor and one or more sensors, wherein the memory is configured to provide the processor with instructions;

wherein the one or more sensors are comprised of:

an accelerometer coupled to the processor and the memory; and/or a gyroscope coupled to the processor and the memory; and/or a forward facing camera coupled to the processor and the memory;

wherein the instructions cause the processor to execute the following steps:

receive sensor data from the one or more sensors, wherein the sensor data is associated with a vehicle;

determine one or more vehicle tilts associated with the vehicle based at least in part on the sensor data by performing one or more of the following:

determining an angular difference between an unloaded overall acceleration applied to the accelerometer and a loaded overall acceleration applied to the accelerometer to obtain an accelerometer tilt as one of the one or more vehicle tilts, by:

determining, using the accelerometer, a first forward tilt angle of the vehicle while the vehicle is unloaded during a stopping maneuver;

determining, using the accelerometer, a second forward tilt angle of the vehicle while the vehicle is loaded during the stopping maneuver; and calculating a difference between the first forward tilt angle and the second forward tilt angle to obtain the angular difference and then utilizing the angular difference to obtain the accelerometer tilt as one of the one or more vehicle tilts; and/or determining a side angular difference between an unloaded overall turning torque applied to the gyroscope and a loaded overall turning torque applied to the gyroscope to obtain a gyroscope tilt as one of the one or more vehicle tilts, by:

determining, using the gyroscope, a first side tilt angle of the vehicle while the vehicle is unloaded during a turning maneuver;

determining, using the gyroscope, a second side tilt angle of the vehicle while the vehicle is loaded during the turning maneuver; and calculating a difference between the first side tilt angle and the second side tilt angle to obtain the side angular difference and then utilizing the side angular difference to obtain the gyroscope tilt as one of the one or more vehicle tilts; and/or determining a series of horizon point shifts as observed by the forward facing camera to obtain a camera tilt as one of the one or more vehicle tilts, by:

determining, using the forward facing camera, a first horizon point shift of the vehicle when traveling forward;

determining, using the forward facing camera, a second horizon point shift of the vehicle when turning sharply or stopping suddenly; and calculating a difference between the first horizon point shift and the horizon point shift to obtain the camera tilt as one of the one or more vehicle tilts;

determine a load imbalance factor associated with the vehicle based at least in part on the one or more vehicle tilts;

store the load imbalance factor in the memory; and determine maintenance information pertaining to brakes, tires, shocks, or any combination thereof associated with the vehicle based at least in part on the load imbalance factor stored in the memory.

2. The system of claim 1, wherein the processor is further to identify and store in memory one or more events based on one or more event detection thresholds and the load imbalance factor, and update event detection thresholds based at least in part on the load imbalance factor, wherein an update to one or more event detection thresholds relates to a change in sensitivity as to what is identified as an event.

3. The system of claim 2, wherein a threshold of the event detection thresholds comprises a turn speed risk threshold, a turn corresponding with tilting of the vehicle.

4. The system of claim 1, wherein a correctly loaded tilt corresponds to an unloaded vehicle tilt.

5. The system of claim 4, wherein the correctly loaded tilt comprises maneuver information of the vehicle based on the sensor data while the vehicle is unloaded.

6. The system of claim 5, wherein the maneuver information comprises one or more of; a maneuver rate and/or a maneuver path.

7. The system of claim 1, wherein the one or more vehicle tilts are determined during a vehicle maneuver of the vehicle.

8. The system of claim 7, wherein the one or more vehicle tilts comprise one or more of: a peak tilts during the vehicle maneuver of the vehicle, an average tilts during the maneuver of the vehicle, or a plurality of tilts of the vehicle along a maneuver path that at least includes the vehicle maneuver of the vehicle.

9. The system of claim 1, wherein the processor is further to determine a vehicle loading profile based at least in part on the one or more vehicle tilts.

10. The system of claim 9, wherein the processor is further to store the vehicle loading profile in the memory.

11. The system of claim 1, wherein the determining of the one or more vehicle tilts associated with the vehicle based at least in part on the sensor data comprises performing:

determining the angular difference between the unloaded overall acceleration applied to the accelerometer and the loaded overall acceleration applied to the accelerometer to obtain the accelerometer tilt as one of the one or more vehicle tilts, by:

determining, using the accelerometer, the first forward tilt angle of the vehicle while the vehicle is unloaded during the stopping maneuver;

determining, using the accelerometer, the second forward tilt angle of the vehicle while the vehicle is loaded during the stopping maneuver; and calculating the difference between the first forward tilt angle and the second forward tilt angle to obtain the angular difference and then utilizing the angular difference to obtain the accelerometer tilt as one of the one or more vehicle tilts.

12. The system of claim 1, wherein the determining of the one or more vehicle tilts associated with the vehicle based at least in part on the sensor data comprises performing:

determining the side angular difference between the unloaded overall turning torque applied to the gyroscope and the loaded overall turning torque applied to the gyroscope to obtain the gyroscope tilt as one of the one or more vehicle tilts, by:

determining, using the gyroscope, the first side tilt angle of the vehicle while the vehicle is unloaded during the turning maneuver;

determining, using the gyroscope, the second side tilt angle of the vehicle while the vehicle is loaded during the turning maneuver; and calculating the difference between the first side tilt angle and the second side tilt angle to obtain the side angular difference and then utilizing the side angular difference to obtain the gyroscope tilt as one of the one or more vehicle tilts.

13. The system of claim 1, wherein the determining of the one or more vehicle tilts associated with the vehicle based at least in part on the sensor data comprises performing:

determining the series of horizon point shifts as observed by the forward facing camera to obtain the camera tilt as one of the one or more vehicle tilts, by:

determining, using the forward facing camera, the first horizon point shift of the vehicle when traveling forward;

determining, using the forward facing camera, the second horizon point shift of the vehicle when turning sharply or stopping suddenly; and calculating the difference between the first horizon point shift and the horizon point shift to obtain the camera tilt as one of the one or more vehicle tilts.

14. A method for determining a load imbalance factor of a vehicle, comprising:

receiving, by a processor, sensor data from one or more sensors, wherein the sensor data is associated with a vehicle;

determining, using the processor, one or more vehicle tilts associated with the vehicle based at least in part on the sensor data by performing one or more of the following:

determining an angular difference between an unloaded overall acceleration applied to an accelerometer and a loaded overall acceleration applied to the accelerometer to obtain an accelerometer tilt as one of the one or more vehicle tilts, by:

determining, using the accelerometer, a first forward tilt angle of the vehicle while the vehicle is unloaded during a stopping maneuver;

determining, using the accelerometer, a second forward tilt angle of the vehicle while the vehicle is loaded during the stopping maneuver; and calculating a difference between the first forward tilt angle and the second forward tilt angle to obtain the angular difference and then utilizing the angular difference to obtain the accelerometer tilt as one of the one or more vehicle tilts; and/or;

determining a side angular difference between an unloaded overall turning torque applied to as gyroscope and a loaded overall turning torque applied to the gyroscope to obtain a gyroscope tilt as one of the one or more vehicle tilts, by:

determining, using the gyroscope, a first side tilt angle of the vehicle while the vehicle is unloaded during a turning maneuver;

determining, using the gyroscope, a second side tilt angle of the vehicle while the vehicle is loaded during the turning maneuver; and calculating a difference between the first side tilt angle and the second side tilt angle to obtain the side angular difference and then utilizing the side angular difference to obtain the gyroscope tilt as one of the one or more vehicle tilts; and/or determining a series of horizon point shifts as observed by a forward facing camera to obtain a camera tilt as one of the one or more vehicle tilts, by:

determining, using the forward facing camera, a first horizon point shift of the vehicle when traveling forward;

determining, using the forward facing camera, a second horizon point shift of the vehicle when turning sharply or stopping suddenly; and calculating a difference between the first horizon point shift and the horizon point shift to obtain the camera tilt as one of the one or more vehicle tilts;

determining a load imbalance factor associated with the vehicle based at least in part on the one or more vehicle tilts;

storing the load imbalance factor in a data memory; and determining maintenance information pertaining to brakes, tires, shocks, or any combination thereof associated with the vehicle based at least in part on the load imbalance factor stored in the data memory.

15. A non-transitory computer readable storage medium comprising computer instructions for:

receiving sensor data from one or more sensors, wherein the sensor data is associated with a vehicle;

determining one or more vehicle tilts associated with the vehicle based at least in part on the sensor data by performing one or more of the following:

determining an angular difference between an unloaded overall acceleration applied to an accelerometer and a loaded overall acceleration applied to the accelerometer to obtain an accelerometer tilt as one of the one or more vehicle tilts, by:

determining, using the accelerometer, a first forward tilt angle of the vehicle while the vehicle is unloaded during a stopping maneuver;

determining, using the accelerometer, a second forward tilt angle of the vehicle while the vehicle is loaded during the stopping maneuver; and calculating a difference between the first forward tilt angle and the second forward tilt angle to obtain the angular difference and then utilizing the angular difference to obtain the accelerometer tilt as one of the one or more vehicle tilts; and/or;

determining a side angular difference between an unloaded overall turning torque applied to a gyroscope and a loaded overall turning torque applied to the gyroscope to obtain a gyroscope tilt as one of the one or more vehicle tilts, by:

determining, using the gyroscope, a first side tilt angle of the vehicle while the vehicle is unloaded during a turning maneuver;

determining, using the gyroscope, a second side tilt angle of the vehicle while the vehicle is loaded during the turning maneuver; and calculating a difference between the first side tilt angle and the second side tilt angle to obtain the side angular difference and then utilizing the side angular difference to obtain the gyroscope tilt as one of the one or more vehicle tilts; and/or determining a series of horizon point shifts as observed by a forward facing camera to obtain a camera tilt as one of the one or more vehicle tilts, by:

determining, using the forward facing camera, a first horizon point shift of the vehicle when traveling forward;

determining, using the forward facing camera, a second horizon point shift of the vehicle when turning sharply or stopping suddenly; and calculating a difference between the first horizon point shift and the horizon point shift to obtain the camera tilt as one of the one or more vehicle tilts;

determining a load imbalance factor associated with the vehicle based at least in part on the one or more vehicle tilts;

storing the load imbalance factor in a data memory; and (5) determining maintenance information pertaining to brakes, tires, shocks, or any combination thereof associated with the vehicle based at least in part on the load imbalance factor stored in the data memory.

* * * * *